United States Patent [19]

Haefner

[11] Patent Number: 5,000,007

[45] Date of Patent: Mar. 19, 1991

[54] CRYOGENIC PUMP OPERATED WITH A TWO-STAGE REFRIGERATOR

[75] Inventor: Hans U. Haefner, Colonge, Fed. Rep. of Germany

[73] Assignee: Leybold Aktiengesellschaft, Fed. Rep. of Germany

[21] Appl. No.: 485,639

[22] Filed: Feb. 27, 1990

[30] Foreign Application Priority Data

Feb. 28, 1989 [EP] European Pat. Off. ..... 89103453.0

[51] Int. Cl.[5] ..... B01D 8/00

[52] U.S. Cl. ..... 62/55.5; 55/269; 417/901

[58] Field of Search ..... 62/55.5, 100, 268; 55/269; 417/901

[56] References Cited

U.S. PATENT DOCUMENTS

| | | | |
|---|---|---|---|
| 4,212,170 | 7/1980 | Winkler | 62/55.5 |
| 4,295,338 | 10/1981 | Welch | 62/55.5 |
| 4,546,613 | 10/1985 | Eacobacci et al. | 62/55.5 |
| 4,555,907 | 12/1985 | Bartlett | 62/55.5 |
| 4,718,241 | 1/1988 | Lessard et al. | 62/55.5 |
| 4,873,833 | 10/1989 | Pfeiffer et al. | 62/55.5 |

*Primary Examiner*—Ronald C. Capossela

*Attorney, Agent, or Firm*—Hill, Van Santen, Steadman & Simpson

[57] ABSTRACT

A cryogenic pump of the type operated with a two-stage refrigerator. A first refrigerator stage includes a plurality of first-stage pump surfaces, and a second refrigerator stage includes a plurality of second stage pump surfaces. The second-stage pump surfaces include a plurality of plates arranged parallel to one another to form a generally cuboid configuration. Each of the plates has a generally rectangular planar surface bounded by a pair of bevels extending angularly from opposite longitudinal edges of the planar surface. The plates are spaced a predetermined distance away from one another, and the bevels have a predetermined width that is equal to or greater than the distance between the plates. The plates are at least partially covered with an adsorption material. In a further embodiment, the plates may include first and second bevel sections.

15 Claims, 3 Drawing Sheets

CRYOGENIC PUMP OPERATED WITH A TWO-STAGE REFRIGERATOR

TECHNICAL FIELD

The invention is directed to a cryogenic pump operated with a two-stage refrigerator. The first, warmer stage of the refrigerator carries pump surfaces that are fashioned as a pot-shaped enclosure having baffle members, in the form of parallel strips, arranged adjacent an upper opening of the enclosure. The refrigerator also includes a second, colder stage, arranged inside the enclosure, which carries pump surfaces that are composed of a plurality of plates. The plates are partially covered with adsorption material and joined to form a generally cuboid shape. This cuboid structure includes longitudinal sides that are arranged parallel to the longitudinal axes of the baffle members.

BACKGROUND OF THE INVENTION

Cryogenic pumps operated with a two-stage refrigerators are becoming increasingly prevalent due to their comparatively high pumping capacity. The first stage of the refrigerators in such pumps is held at about 80 K and carries pump surfaces in the form of baffles that serve the purpose of condensing water vapor and gases having similar boiling temperatures. These baffles also serve to protect the surfaces of the second stage of the pump against direct irradiation. Gases having comparatively lower boiling temperatures (for example, argon) and light gases (such as hydrogen and helium) are to agglomerate at the surfaces of the second stage of the pump, the temperature of which is approximately 20 K. Hydrogen and helium can be retained on these surfaces by adsorption on these surfaces only if they include activated charcoal or similar adsorption materials. The surfaces of the second stage of a cryogenic pump are therefore designed such that gases proceeding through the baffles initially "see" only those surfaces that serve as condensation surfaces for argon and similar gases. The surfaces covered with adsorption material are shielded, and can be only indirectly reached by the lighter gases. It is therefore possible to filter the condensible gases out before they reach the adsorption surfaces, so that the adsorption material is not unnecessarily loaded with condensible gases. The lighter and thus more mobile gases can then more readily reach, and agglomerate at, the adsorption surfaces.

Many attempts have been made to design the pump surfaces of the second stage of the refrigerators of such cryogenic pumps. Known configurations of such designs can be divided into two groups. In the first group, the pump surfaces are composed of disc-shaped, annularly-shaped, or conically- shaped plates, and have a structure that is dynamically balanced overall (e.g., see European Pat. application Nos. 128 323, 134 942, and 185 702, as well as German Pat. application Nos. 28 21 278, 29 12 856, and 30 38 418). These designs require baffles that, like the pump surfaces, must be constructed in a dynamically balanced configuration.

In the second group, the pump surfaces are composed of a plurality of essentially planar sheet metal sections that are joined together to form a parallelepipedal or cuboid structure (e.g., see European Pat. application No. 196 281 and German Pat. application No. 26 20 880). With designs incorporating pump surface configurations of this type, baffles that are composed of a plurality of metal strips are arranged parallel to one another.

Compared to the pump surfaces of the second group, the pump surfaces of the first group are disadvantageous in that they must be more carefully manufactured and assembled due to their dynamically balanced structure, particularly with respect to equipping pumps of various sizes with such pump surfaces.

Pumps employing pump surfaces of the second group are frequently used in systems involving sputtering processes, which generate comparatively large quantities of condensible gases (particularly argon) and of adsorbable gases (particularly hydrogen). In such pumps, the pumping capacity for these gases is dependent on the conductance of the entrance baffle, but is particularly dependent on the surface that is presented to the respective gas as a entry surface on the inside of the pump. For argon, this "entry surface" is the outer surface of the pump surface configuration. For hydrogen, the entry surface is established by the gaps and openings on the outside surface of the pump surface configuration. Hydrogen can penetrate these gaps and openings to enter into shielded regions having a coating of activated charcoal, upon which the hydrogen agglomerates.

In pumps having pump surfaces of the second type, the planar sheet metal sections are formed as laterally extending side plates. These side plates have outside surfaces which serve the purpose of agglomerating condensible gases. In such pumps, the pumping capacity for argon is therefore dependent on the size of the outside surfaces. Lighter gases such as hydrogen can penetrate to the surfaces covered with adsorption material only from below, or through the end faces, of the pump surface configurations. The pumping capacity of such pumps for hydrogen is therefore dependent on the size of these entry surfaces.

In known pumps having pump surfaces of essentially parallelepipedal or cuboid structure, the two entry surfaces compete with one another to a certain extent. That is, when the surface intended for the agglomeration of argon (i.e., the outside surface of the plates) is enlarged, the entry surface for light gases is reduced in size, thus incurring an associated reduction in the pumping capacity for light gases. The converse is also true, in that when the surfaces through which lighter gases can proceed to the surfaces covered with adsorption material are enlarged, the size of the outer surface is necessarily reduced, thus reducing the pumping capacity for condensing gases.

It can thus be seen that the need exists for a cryogenic pump of the type operated with a two-stage refrigerator, wherein the pump surfaces of the second stage have both an improved pumping capacity for condensible gases as well as an improved pumping capacity for light gases. Moreover, the pump surfaces of the second stage should be able to be manufactured and assembled simply and cost effectively, regardless of the type of pump to which they are to be applied.

SUMMARY OF THE INVENTION

The present invention overcomes the above-described disadvantages by providing a cryogenic pump operated with a two-stage refrigerator, wherein the pump includes a first refrigerator stage including a plurality of first-stage pump surfaces, and a second refrigerator stage including a plurality of second-stage pump surfaces. The second-stage pump surfaces include a plurality of plates arranged parallel to one another to form a generally parallelepipedal configuration. Each of the plates has a generally rectangular planar surface bounded by a pair of bevels extending angularly from opposite longitudinal edges of the planar surface. Thus, the pump of the present invention is of the general type described hereinabove with reference to the second group.

The bevels serve to shield the rectangular planar surfaces of the plates, which are at least partially covered with adsorption material. The bevels have upwardly facing surfaces that serve as condensation surfaces for condensible gases.

In a pump surface configuration of this type, the number and size of the bevels define the pumping capacity for condensible gases. The plates are spaced a predetermined distance away from one another, and thus present gaps at the end faces and longitudinal sides of the parallelepipedal form that define the pumping capacity for light gases. The present invention provides a pumping capacity for light gases, (e.g., hydrogen), that is significantly greater than that of a corresponding pump surface of previously known devices. This is particularly significant when coupled with the fact that the increased pumping capacity for hydrogen is achieved without reducing the pumping capacity for condensible gases. When the width of the bevels of the plates is selected such that it corresponds to the spacing of the plates, then the sum of the area of the surfaces of the bevels is equal to the side area of the cuboid pump surface. The selection of equal measurements therefore provides a significant increase in hydrogen pumping capacity without changing the pumping capacity for condensible gases.

Additionally, it is also possible, with the pump of the present invention, to select the width of the bevels to be greater than the predetermined distance between the plates. Such a configuration provides not only an increased hydrogen pumping capacity, but also an increased pumping capacity for condensible gases.

Other objects and advantages of the present invention will become apparent upon reference to the accompanying description when taken in conjunction with the following drawings.

DETAILED DESCRIPTION OF THE PREFERRED EMBODIMENTS

Figure 1:
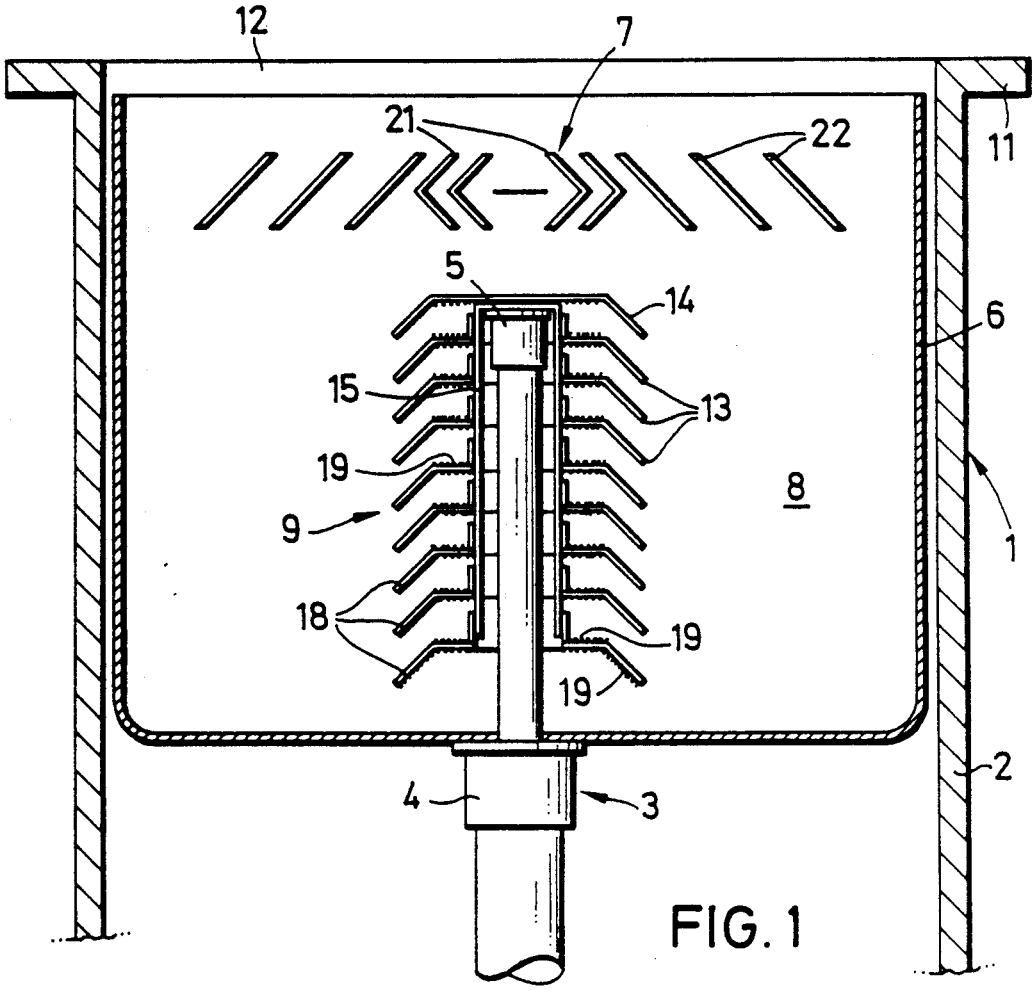
FIG. 1 is a sectional view of a cryogenic pump embodying the present invention.

FIG. 1 shows a cryogenic pump 1 including a housing 2 enclosing a two-stage refrigerator 3 (only partially shown). The refrigerator 3 includes a first, warmer stage 4 and a second, colder stage 5. The first stage 4 includes a pump surface 6 in the form of a pot-shaped enclosure. The pump surface 6 is secured in thermally conductive contact with the first stage 4. The pump surface 6 carries a plurality of baffles 7 at an upper opening thereof and, together with the baffles 7, defines an interior chamber 8 of the pump. The second stage 5 of the refrigerator 3 is disposed within at the interior 8 of the pump 1. A plurality of pump surfaces 9 are secured in thermally conductive contact with the second stage 5, and are arranged to have a generally parallelepipedal configuration. The housing 2 of the cryogenic pump 1 is equipped with a flange 11 that forms an entrance aperture 12 of the cryogenic pump 1. The cryogenic pump 1 is connected to a recipient (not shown) via the entrance aperture 12, preferably with a valve (also not shown) interposed therebetween.

During operation of the pump 1, gases having a higher boiling point agglomerate at the baffles 7 and the pump surface 6. Gases having lower boiling points, predominantly argon, and light gases, predominantly hydrogen, proceed through the baffles 7 into the pump interior 8. The pump surfaces 9 serve the purpose of agglomerating these gases.

In the embodiment shown in FIG. 1, the pump surfaces 9 include a total of 9 plates. The lower 8 plates are referenced 13, and the uppermost plate is referenced 14. All plates 13 and 14 are secured in thermally conductive contact with the second stage 5 of the refrigerator 3. Each of the plates includes a generally rectangular planar surface with bevels 18 angularly extending from longitudinal sides thereof. The bevels 18 extend away from the baffles 7. A generally U-shaped central carrier 15 includes legs extending parallel to the second stage 5 of the refrigerator 3. The carrier 15 includes a base section which connects the legs of the U together, and is secured in thermally conductive contact to the second stage 5.

The pump surfaces 9 of the second stage 5 serve to agglomerate predominantly argon by condensation, and to agglomerate predominantly hydrogen by adsorption (note that here, and throughout the specification, argon is used for illustrative purposes as an example of a condensible gas having a relatively low boiling temperature). The outside surfaces of the essentially parallelepipedal pump surface structure a (i.e., the surface of the plate 14 and the surfaces of the bevels 18 facing toward the baffles 7), have surface structure that is suitable for the purpose of condensing argon. The combined area of these surfaces defines the argon pumping capacity of the cryogenic pump. These surfaces also serve to shield the adsorption surfaces of the pump from condensation gases. The surfaces of the plates 13 and 14 that are shielded from condensible gases, the plate sections extending parallel to the plane of the baffles 7, serve to agglomerate light gases, such as hydrogen, by adsorption. Toward this purpose, these surfaces are therefore at least partially coated with adsorption material 19, for example activated charcoal. The area of the surfaces coated with activated charcoal 19 depends on the desired hydrogen pumping capacity. When an extremely high hydrogen pumping capacity is desired, the surfaces of the bevels 18 facing away from the baffles 7 can also be covered with adsorption material 19, as shown with reference to the lower plate 13 of FIG. 1.

The baffle strips 7 of FIG. 1 are shown as chevron baffle strips 21 immediately above the pump surfaces 9, and louver baffle strips 22 in the radially outer region of the pump surface 6. Compared to previously known baffle arrangements, in which only louver baffles are provided, the combination of louver baffles with chevron baffles further improves pumping capacity. Due to the presence of chevron baffles in the middle region of the pump surface 6, the chevrons 21 provide a pump surface for argon and hydrogen, although the pumping capacity for these gases is small by comparison to the pump surfaces 9.

Figure 2:
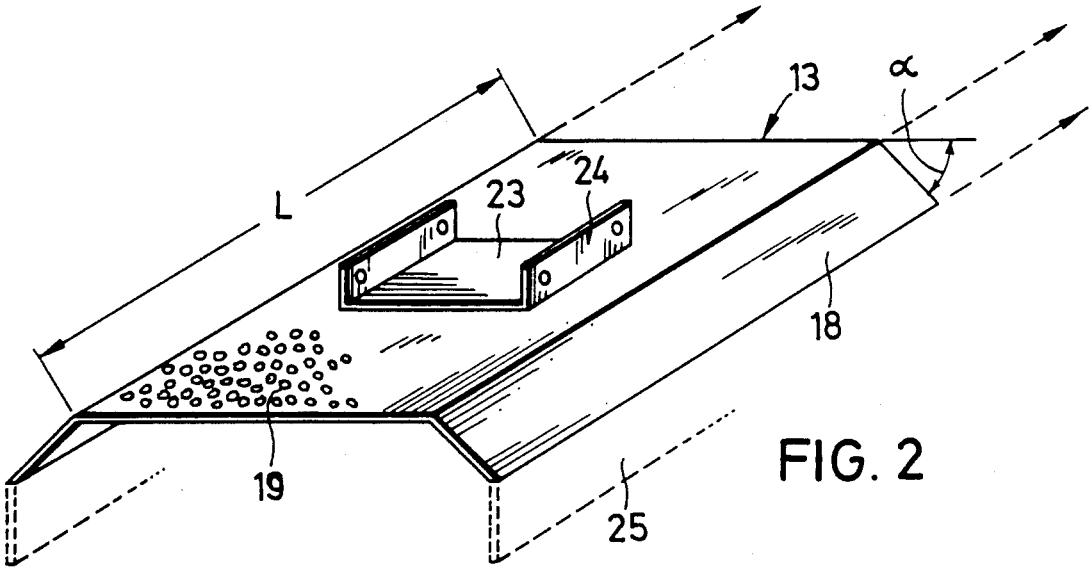
FIG. 2 is an isometric view of one of the plates forming the pump surfaces shown in FIG. 1.

FIG. 2 shows an individual plate 13 and illustrates structure that is used to fasten the plates 13 to the central carrier 15. Each plate 13 is equipped with a central opening 23. Clips 24 that extend perpendicularly relative to the planar surface of the plate 13 are provided at opposite sides of the opening 23. The plates 13 are secured to the central carrier 15 with the assistance of these clips 24. The central opening 23 is omitted in the uppermost plate 14 of the front surfaces 9, since the plate 14 lies directly on the base section of the U-shaped carrier 15 that is secured to the refrigerator stage 5. The clips 24 and the bevels 18 extend in opposite directions with respect to the planar surface of the plates 13. This arrangement facilitates simple assembly of the pump surfaces 9 in that, when the plates 13 are attached to the carrier 15 from bottom to top, the clips 24 and the connecting screws securing them to the carrier 15 are freely accessible.

As is apparent from the configuration of the plates 13 shown in FIG. 2, the plates are simple and economical to manufacture. The bevel 18 forms an angle $\alpha$ of about 45° with the planar surface of the plate 13. This angle may be varied to influence the hydrogen pumping capacity of the pump 3. When larger pumps are to be equipped with the pump surface 9 of the present invention, it is frequently sufficient merely to select a longer length L for the plates 13, rather than significantly changing the configuration of the pump surfaces.

When an especially high ratio of argon pumping capacity to hydrogen pumping capacity to hydrogen pumping capacity is desired, the plates 13 may be provided with a bevel 25 in addition to the bevel 18. The bevels 25 extend from the bevels 18 and form an angle of approximately 90° with the planar surface of the plate 13.

Figure 3:
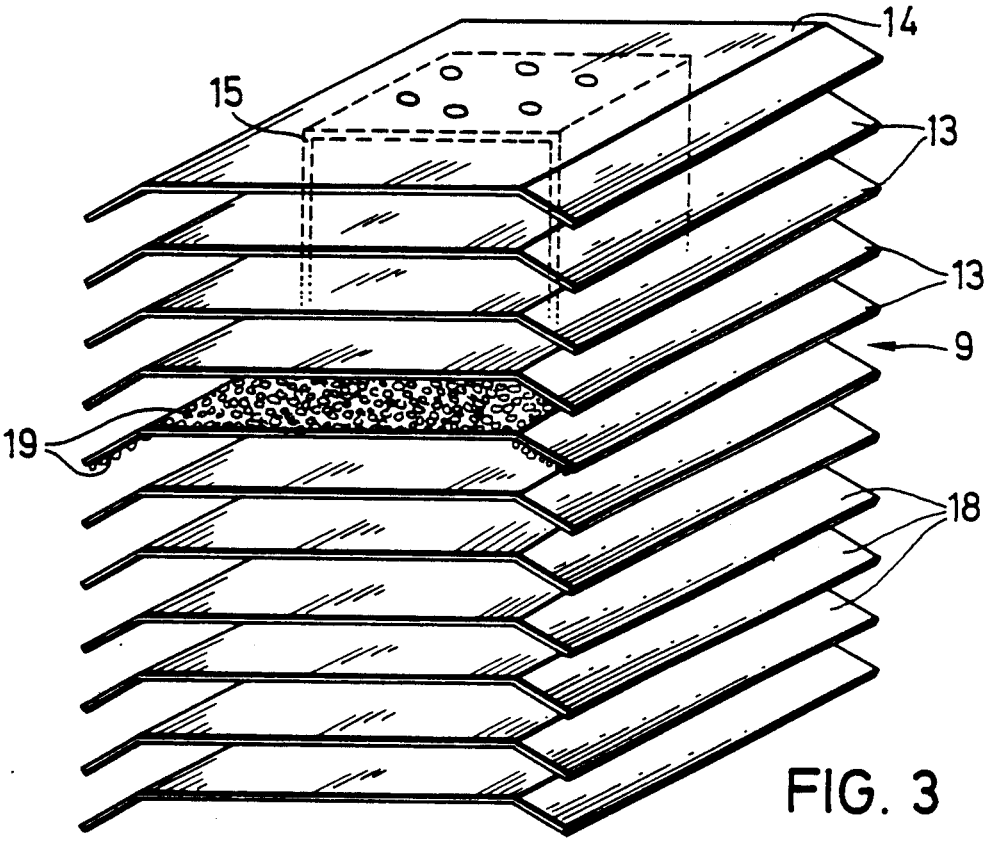
FIG. 3 is an isometric schematic view of the pump surface configuration of the present invention.
Figure 4:
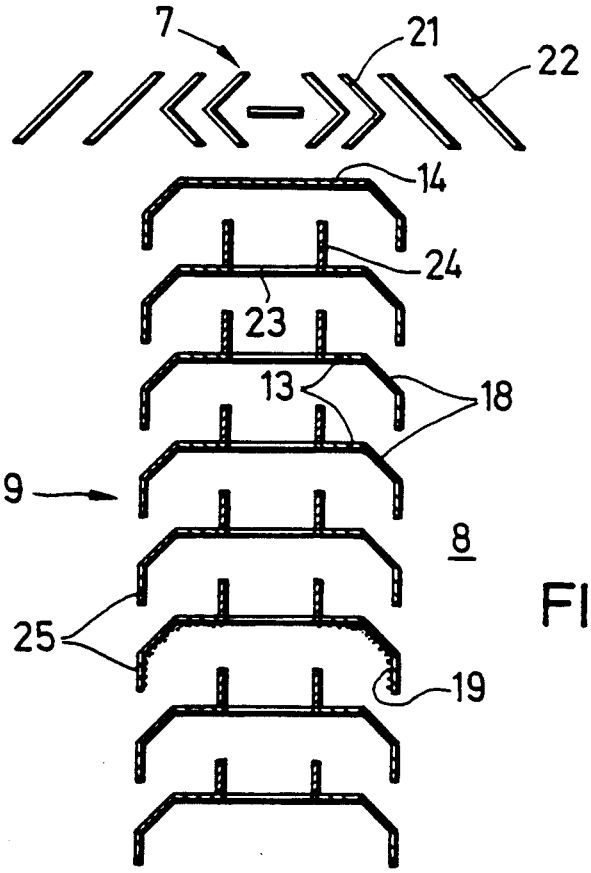
FIG. 4 is a sectional view of a further embodiment of the present invention.

FIG. 3 shows an embodiment of the present invention having pump surfaces 9 including a total of 11 plates 13, 14 spaced a relatively small distance away from one another. Such an arrangement having an extremely tight combination of the individual plates is particularly suited for cryogenic pumps employed in sputtering processes, wherein a high pumping capacity for both argon and hydrogen is desired. In the exemplary embodiment of FIG. 4, the individual plates are spaced a larger distance away from one another and two bevels 18 and 25 are provided. An arrangement as shown in FIG. 4 is particularly advantageous in applications where weight savings are desireable, for example in especially large cryogenic pumps having relatively large cooling surfaces. The use of relatively heavy, tightly-stacked pump-surface plates is undesirable in such applications.

Figure 5:
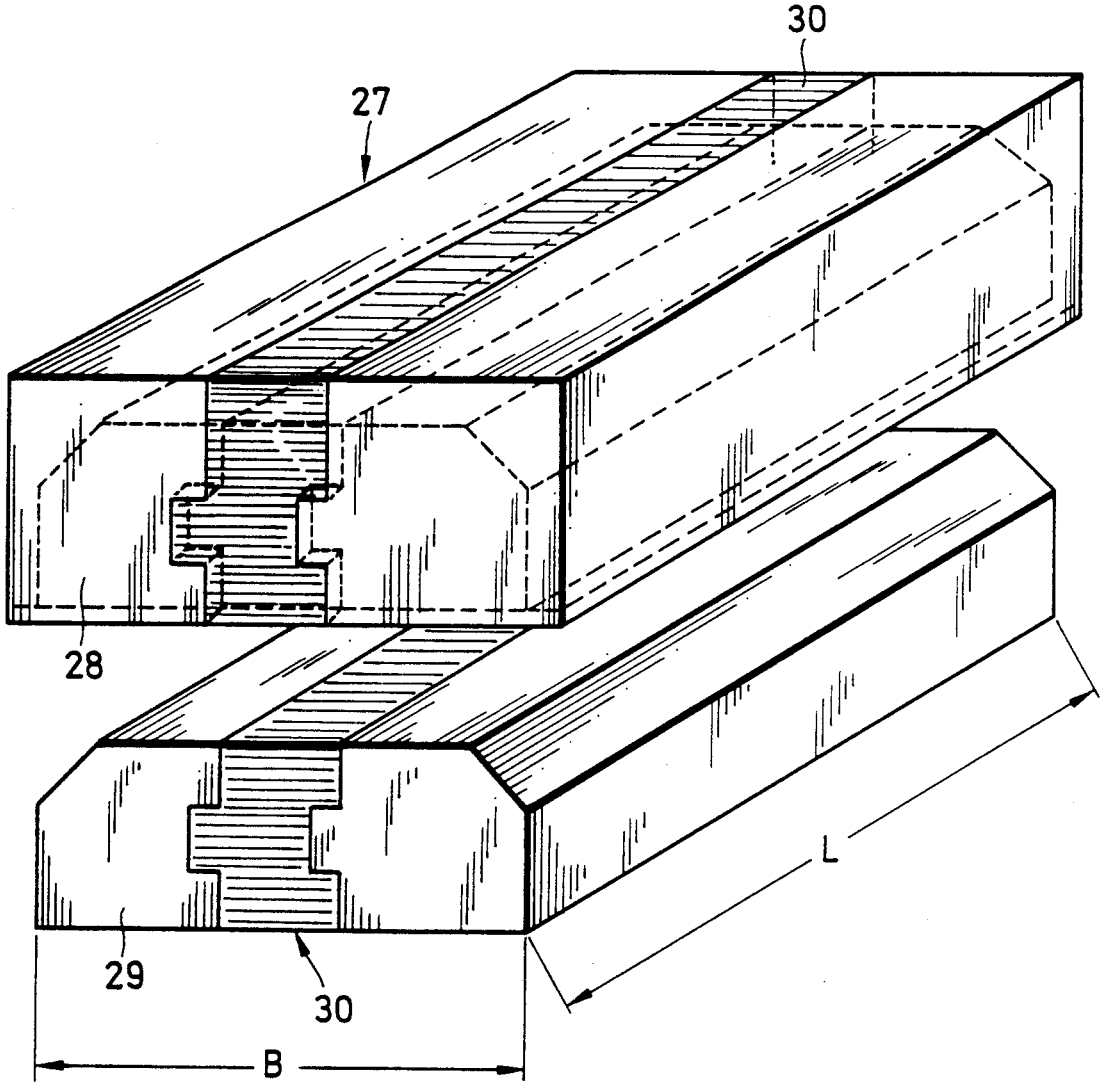
FIG. 5 is an isometric view of a tool for manufacturing the individual plates forming a portion of the present invention.

FIG. 5 shows a tool for manufacturing plates 13, 14 of the pump surfaces 9 of the present invention. A production master tool 27 includes an upper part 28 and a lower part 29. The shape of the tool 27 and its length L are selected so that the tool suitable for manufacturing pump surfaces of cryogenic pumps having different sizes or configurations. The length L of the tool 27 corresponds to a maximally desired length of a plate 13, so that modification of the tool 27 to produce plates having different lengths is not required. The shape of the tool 27 is selected such that both a simple beveling (bevels 18 only) as well as a double beveling (bevels 18 and 25) can be achieved on the same tool. This shape eliminates the need to provide different tools for different shapes. Furthermore, the tool 27 also provides for a variable width B. The upper and lower tool parts are provided with selectively insertable intermediate elements 30. Thus, relatively simply manufactured intermediate elements 30 having differing widths can be provided in lieu of completely separate master tools.

Although the present invention has been described with reference to a specific embodiment, those of skill in the art will recognize that changes may be made thereon without departing from the scope and spirit of the invention as set forth in the appended claims.

I claim as my invention:

1. A crypogenic pump of the type operated with a two-stage refrigerator, said pump comprising the following:

a first refrigerator stage having pump surfaces including an enclosure with an upper opening, said first stage further including a plurality of baffle strips adjacent said opening;

a second refrigerator stage, disposed inside said enclosure, having pump surfaces including a plurality of plates having surfaces at least partially covered with adsorption material, said plates being disposed in registry in a generally parallelepipedal configuration having a longitudinal dimension extending generally parallel to said baffle strips;

each of said plates of said second stage including a generally rectangular planar surface bounded by a pair of bevels extending angularly from opposite longitudinal edges of the respective planar surface, and said planar surfaces of said plates being generally spaced parallel to one another so that said bevels in combination form means for agglomerating condensible gases and for shielding aid planar surfaces from said condensible gages.

2. A cryogenic pump according to claim 1, wherein said second stage comprises a thermally conductive central carrier to which said plates are secured.

3. A cryogenic pump according to claim 2, wherein said carrier has an inverted U-shape, with legs extending parallel to said second stage, and said carrier further includes a base section that joins said legs together and is secured to said second stage.

4. A cryogenic pump according to claim 3, wherein each of said plates further comprises the following:

a central opening in said planar surface; and at least one clip adjacent said central opening, said at least one clip being secured to, and in thermally conductive contact with, said carrier.

5. A cryogenic pump according to claim 4, wherein said at least one clip comprises a pair of clips extending at right angles from said planar surface.

6. A cryogenic pump according to claim 1, further wherein:

said plates are spaced a predetermined distance away from one another;

said bevels have a predetermined width; and said predetermined width is greater than said predetermined distance.

7. A cryogenic pump according to claim 1, wherein each of said bevels comprises the following:

a first bevel section extending from said planar surface at a first predetermined angle with respect to said planar surface; and a second bevel section extending from said first bevel section at a second predetermined angle with respect to said planar surface.

8. A cryogenic pump according to claim 7, wherein said first predetermined angle is approximately 45° and said second predetermined angle is approximately 90°.

9. A cryogenic pump according to claim 1, wherein said bevels comprise surfaces, facing away from said baffles, that are coated with an adsorption material.

10. A cryogenic pump according to claim 1, wherein at least one of said baffle strips is provided as a louver, and at least one of said baffle strips is provided as a chevron.

11. A cryogenic pump of the type operated with a two-stage refrigerator, said pump comprising the following:

a first refrigerator stage including a plurality of first-stage pump surfaces; and a second refrigerator stage including a plurality of second-stage pump surfaces;

said second-stage pump surfaces including a plurality of plates arranged parallel to one another to form a generally parallelepipedal configuration, each of said plates having a generally rectangular planar surface bounded by a pair of bevels extending angularly from opposite longitudinal edges of said planar surfaces.

12. A cryogenic pump according to claim 11, wherein:

said plates are spaced a predetermined distance away from one another;

said bevels have a predetermined width; and said predetermined width is greater than said predetermined distance.

13. A cryogenic pump according to claim 12, wherein each of said bevels comprises a lower surface upon which is deposited an adsorption material.

14. A cryogenic pump according to claim 12, wherein each of said bevels comprises the following:

a first bevel section extending from said planar surface at a first predetermined angle with respect to said planar surface; and a second bevel section extending from said first bevel section at a second predetermined angle with respect to said planar surface.

15. A cryogenic pump according to claim 14, wherein said first predetermined angle is approximately 45°, and said second predetermined angle is approximately 90°.

* * * * *